US005324004A

United States Patent [19]

Richardson

[11] Patent Number: 5,324,004

[45] Date of Patent: Jun. 28, 1994

[54] VEHICLE RAMP

[75] Inventor: Robert K. Richardson, Minerva, Ohio

[73] Assignee: Ganeaux Industries, Inc., Salem, Ohio

[21] Appl. No.: 93,558

[22] Filed: Jul. 19, 1993

[51] Int. Cl.[5] ..... E02C 3/00

[52] U.S. Cl. ..... 254/88

[58] Field of Search ..... 254/88; 14/69.5; 248/352, 188.2, 346; D34/32

[56] References Cited

U.S. PATENT DOCUMENTS

D. 228,301 9/1973 Lundman .
D. 232,020 7/1974 Borsuk .
D. 237,162 10/1975 Miller .
D. 239,610 4/1976 Miller .
D. 313,102 12/1990 Cano .
2,279,464 4/1942 Jackson .
2,450,648 10/1948 Felzer .
3,638,910 2/1972 Nellis et al. .
3,847,376 11/1974 Binding .
3,870,277 3/1975 West .
3,917,227 11/1975 West .
4,050,403 9/1977 Miller .
4,421,300 12/1983 Lundman .

*Primary Examiner*—Robert C. Watson
*Attorney, Agent, or Firm*—Michael Sand Co.

[57] ABSTRACT

A vehicle ramp is formed as a unitary sheet metal member and has a inclined ramp portion provided with longitudinally spaced rows of stiffening bosses and a flat reinforcement area at a lower end of the ramp. A raised wheel rest portion has a generally flat bottom surface and is reinforced by a transverse projection which terminates at a pair of longitudinally extending side depression formed at the junction of the wheel rest portion and the ramp. A pair of raised rails extend completely along the sides of the ramp and wheel rest portion, and downwardly along the sides of an end wall which forms the elevating rear support portion of the ramp. The stiffening bosses are arranged in alternating rows of three and four bosses per row. A stop is formed at the junction of the wheel rest portion and the elevating support portion and has a rearwardly inclined transverse stiffening projection. The particular arrangement of bosses, side rails, and various depressions and projections provide a strong support ramp with a reduced metal thickness and weight without sacrificing safety.

23 Claims, 5 Drawing Sheets

VEHICLE RAMP

BACKGROUND OF THE INVENTION

1. Technical Field

The invention relates to vehicle ramps of the type for supporting a wheel or wheels of a vehicle sufficiently clear of the ground to enable a person to slide under the vehicle for underside inspection and/or repair purposes.

More particularly, the invention relates to a vehicle ramp formed as a single stamp sheet metal member of a relatively light gauge yet which is exceedingly strong and safe.

2. Background Information

Many vehicle owners perform routine maintenance and repairs on their vehicles. In order to gain easy access to the underside of the vehicle they will elevate either the front or rear portion of the vehicle on which they are working to provide such access. Various portable ramps have been used by amateur auto mechanics and vehicle owners for this purpose. These ramps are usually formed of metal and have various configurations to enable the vehicle wheel to be driven up an incline portion of the ramp, afterwhich it settles into a wheel retaining area of the ramp.

Prior examples of such metal ramps are shown in U.S. Pat. Nos. 2,279,464, 2,450,648, 3,638,910, 3,847,376, 3,870,277, 3,917,227, 4,421,300 and 4,050,403; and in U.S. Pat. Nos. D 228,301, D 232,020, D 237,162, D 239,610 and D 313,102.

Although many of these prior art ramps are satisfactory for their intended purpose, it is always desirable to be able to manufacture such a ramp at a reduced cost and of a lighter weight, in order for it to be more easily handled by the user, but without sacrificing any safety to the user thereof. It is also desirable to manufacture such a vehicle ramp as an integral one-piece member free of moving parts which require manipulation and are subject to breakage and maintenance.

Therefore, the need exists for an improved vehicle ramp which enables the user to drive one of the vehicle wheels along the ramp to a safe resting position, whereat the vehicle will be safely supported for subsequent repair and maintenance, by a lightweight, yet sturdy and durable device, free of moving parts which require extra manipulation by the user thereof.

SUMMARY OF THE INVENTION

Objectives of the invention include providing an improved vehicle ramp which is formed as an integral one-piece member from stamp sheet metal material, in which the sheet metal is of a relatively thin gauge than heretofore used for prior ramps, but without sacrificing strength and safety.

A still further objective of the invention is to provide such a vehicle ramp which is formed with a unique series and arrangement of truncated conical shaped bosses which provide strength and rigidity to the incline track portion of the ramp along which the vehicle tire rolls until it reaches its rest position, as well as providing traction areas for the tire while moving up the inclined ramp surface to reduce slippage of the tire.

Another objective is to provide such a vehicle ramp which has uniquely located longitudinal and transverse depressions and projections in the rear support member and in a transition zone located between the inclined ramp and wheel rest area, to provide the necessary strength and rigidity to the one-piece metal member to enable the thinner gauge material to be utilized in forming the ramp.

A further objective is to provide such a vehicle ramp which has a stop at the rear of the ramp to prevent the tire from rolling off the end of the ramp, and which has a secondary stop member on an opposite end of the wheel rest area to assist in retaining the wheel in the rest area after having passed over the secondary stop.

A still further objective is to provide such a vehicle ramp which has a transverse flat area at the entrance end of the ramp which provides rigidity to the inclined portion of the ramp as well as preventing the ramp from sliding forward as the vehicle wheel begins to roll upwardly along the inclined portion.

Another objective is to provide such a vehicle ramp which contains a pair of side rails which extend continuously throughout and along both sides of the ramp to provide rigidity to the ramp; and in which each of the rails has two distinct arcuate curved areas which enable the ramp to resist bending as the wheel rolls along the ramp and onto the wheel rest area.

Still another objective of the invention is to provide such a vehicle ramp in which the inclined track has two distinct planar areas which form different angles with respect to the horizontal to enable the wheel to roll along the ramp without under portions of the vehicle contacting the ramp, such as the spoilers on sports cars or similar vehicles.

These and other objectives and advantages of the invention are achieved by the improved vehicle ramp, the general nature of which may be stated as including a unitary sheet metal body having an inclined ramp portion, a raised wheel rest portion, and a rear support portion; said ramp portion having a track formed with a plurality of longitudinally spaced parallel transverse rows of outwardly projecting bosses, the individual bosses of each row being located intermediate an adjacent pair of bosses in the longitudinal adjacent row; said track terminating in a lower transverse planar end adapted to engage the ground and an upper transition zone merging into the wheel rest portion; stop means adjacent the junction of the wheel rest portion and rear support portion; and a pair of rails extending longitudinally along opposite sides of the ramp portion, the wheel rest portion, and the rear support portion, said rails being similar, each having at least first and second arcuate curved portions, said first arcuate portion extending throughout the longitudinal length of the track and into the transition zone, and the second arcuate portion extending from said first arcuate portion throughout the longitudinal length of the wheel rest portion and terminating adjacent the rear support portion.

BRIEF DESCRIPTION OF THE DRAWINGS

A preferred embodiment of the invention, illustrative of the best mode in which applicant has contemplated applying the principles, is set forth in the following description and is shown in the drawings and is particularly and distinctly pointed out and set forth in the appended claims.

Similar numerals refer to similar parts throughout the drawings.

DESCRIPTION OF THE PREFERRED EMBODIMENT

Figure 2:
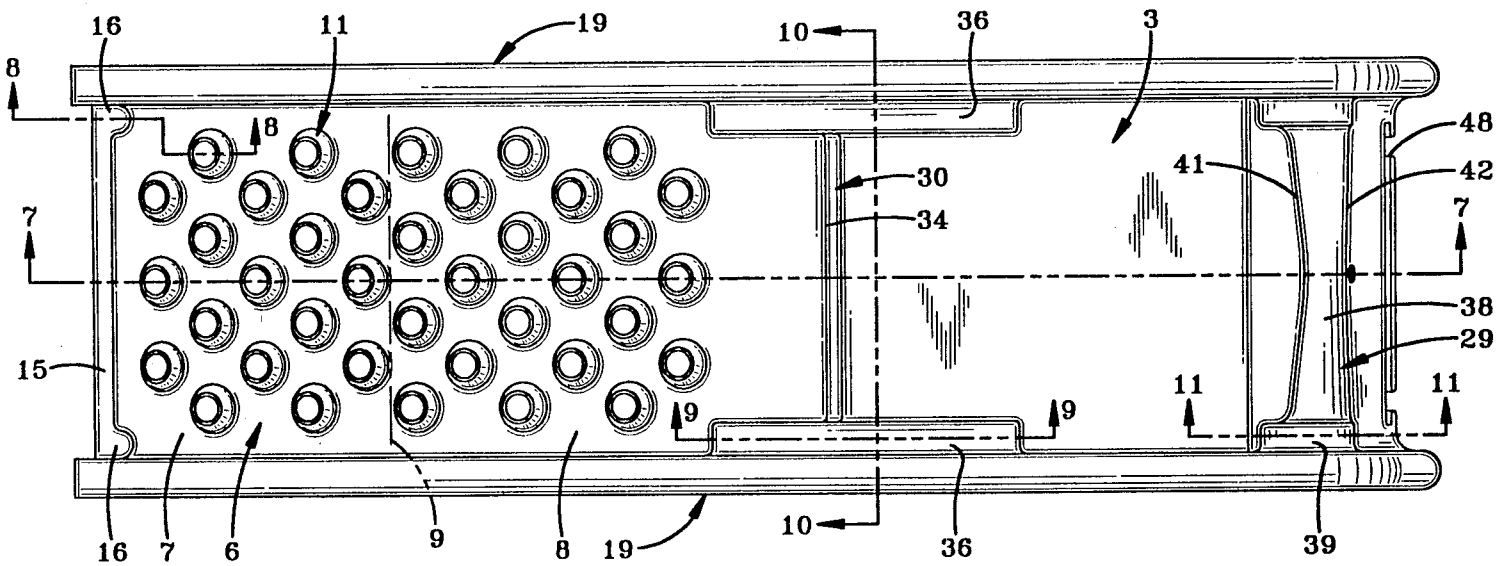
FIG. 2 is a top plan view thereof.

The improved vehicle ramp of the invention is shown particularly in FIGS. 1-5, and is indicated generally at 1. Ramp 1 is formed as a unitary sheet metal body stamped of flat sheet steel into the particular unique configuration shown in the drawings and described below. Ramp 1 includes an inclined ramp portion, a raised wheel rest portion, and a rear support portion, indicated generally at 2, 3 and 4 respectively.

Figure 12:
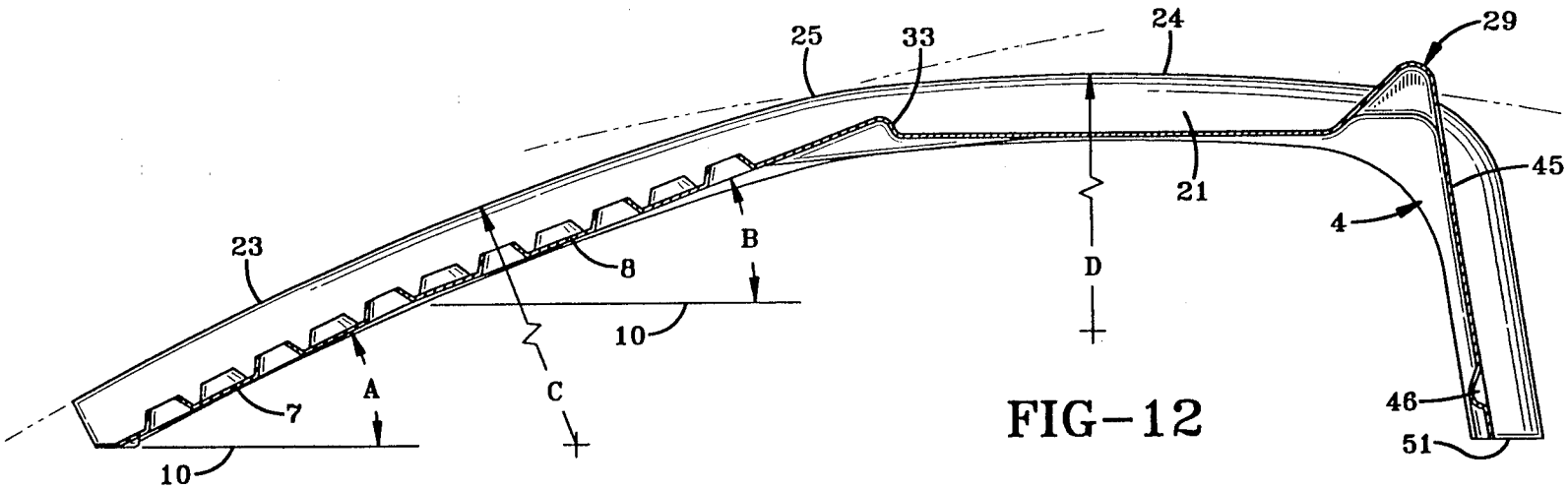
FIG. 12 is a diagrammatic sectional view similar to FIG. 7, showing the various angles of the ramp surface and the compound curvature of the side rails.

Ramp portion 5 includes a track 6, and in accordance with one of the features of the invention, track 6 includes a lower planar portion 7 and an upper planar portion 8 (FIG. 2) which merge together at 9. As shown in FIG. 12, lower planar portion, 7 forms an angle A with the horizontal indicated at 10, with upper planar portion 8 forming an angle B with horizontal 10. Preferably, angle A is approximately 21° and angle B is 24°. This relationship has been found to avoid or materially reduce the lower underside portion of a car and in particular the spoilers on a sportscar from rubbing against the ramp as the vehicle wheel moves upwardly along track 7.

Figure 8:
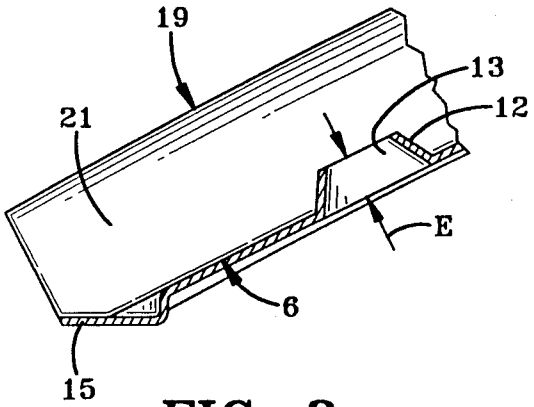
FIG. 8 is an enlarged fragmentary sectional view taken on line 8—8, FIG. 2.
Figure 11:
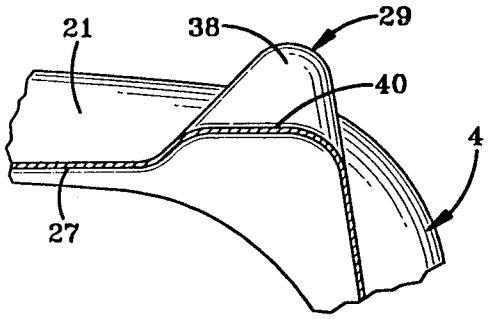
FIG. 11 is an enlarged fragmentary sectional view taken on line 11—11, FIG. 2.

A series of longitudinally spaced, transversely extending rows of bosses 11 are formed in track 6. The various bosses are similar to each other, each being formed as a raised frustro conical member having a conical sidewall 12 with a top circular opening 13. It has been found that the most satisfactory results are achieved by making the vertical height of each boss, best shown in FIG. 8 and indicated by arrow E, approximately ½ the size of the diameter of top opening 13. In the preferred embodiment, height E is approximately 5/16 inches and the diameter of circular opening is ⅝ inches.

In accordance with another feature of the invention, it has been determined that the particular spacing and arrangement of the individual bosses throughout track 6 assists in achieving the necessary strength with a minimum thickness of metal. In particular, the individual bosses lie intermediate the pair of bosses in the longitudinally adjacent rows, as can be seen particularly in FIGS. 2, 3, 5 and 6. Also, it has been found that by alternating number of bosses in adjacent rows, namely three bosses in one row, then four bosses in the next row, and then three bosses etc. again provides increased strength with a minimum thickness of material.

A transversely extending flat bottom area 15 is formed along the bottom edge of track 6 and terminates in two slightly enlarged end pads 16. Flat bottom area 15 and pads 16 stiffen the lower end of ramp portion 2 assisting ramp being able to withstand the weight placed thereon by the vehicle wheels, and also assist in preventing ramp 1 from sliding rearwardly (arrow F, FIG. 1), as the vehicle wheel begins moving upwardly along track 6.

A pair of side rails, each of which is indicated generally at 19, extends continuously from beyond flat bottom area 15 along ramp portion 2, wheel rest portion 4 and downwardly along rear support portion 4. Ramps 19 have an inverted U-shaped cross-sectional configuration as shown particularly in FIG. 10, having a pair of sidewalls 20 and 21 with a curved web wall 22.

In accordance with another feature of the invention which is best illustrated in FIG. 12, side rails 19 have a pair of curved arcuate sections indicated at 23 and 24, each having its own radius of curvature indicated by arrows C and D, respectively. The two arcuate sections meet at a junction 25. It has been found that this compound radii of curvature of the rails provides a spring like effect to the ramp, which enables it to sustain the weight of the vehicle without buckling, again with a minimum metal thickness. In the preferred embodiment, the lengths of radius C is approximately 78 inches and the length of radius D is approximately 58 inches, and the arcuate lengths of curvatures developed by radii C and D are approximately 19 and 15 inches, respectively.

Wheel rest portion 3 includes a generally flat planar surface 27 (FIG. 7) which extends between a rear stop member indicated generally at 29, and a forward secondary stop member 30. Secondary stop 30 is located at and forms a portion of a transition zone indicated at 31, which is the area where ramp track 6 merges into and joins with flat planar surface 27 of wheel rest portion 3. Secondary stop 30 includes a downwardly outwardly inclined wall 33 which merges into the end of upper planar portion 8 of track 6 at a rounded corner 34. Corner 34 extends vertically above flat planar surface 27 to resist a vehicle wheel from rolling backwards and down along track 6, after it has reached its at rest position on surface 27.

Figure 10:
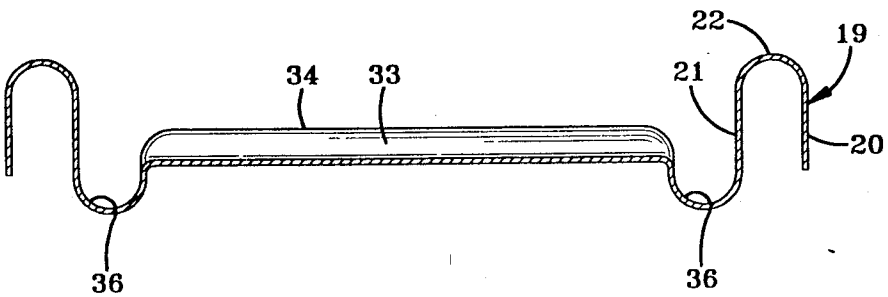
FIG. 10 is an enlarged fragmentary sectional view taken on line 10—10, FIG. 2.

A pair of longitudinally extending depressions 36 (FIGS. 2, 3, 9 and 10) are formed in and extend from upper planar portion 8 of track 6, and in particularly from adjacent to the uppermost row of bosses 11, partially into flat planar surface 27 of wheel rest portion 3. Depressions 36 communicate with secondary stop 30 and provide a stiffening effect to the ramp in the transition zone. The longitudinal length of each depression 36 is approximately equal to the transverse spacing between the depressions, which is the same as the length of secondary stop 30, and in particular top rounded corner 34 thereof. Depressions 36 preferably have a U-shaped cross sectional configuration as shown in FIG. 10.

Rear stop 29 includes a generally dome-shaped convex projection 38 which extends transversely generally across the rear end of wheel rest portion 3 at the junction with rear support portion 4. Projection 38 terminates in a pair of short longitudinally extending channels 39 (FIGS. 2-5 and 11), which have generally flat planar bottom surfaces 40. Dome-shaped projection 38 has an outwardly flared somewhat V-shaped transverse front wall 41, and a relatively straight transversely extending rear wall 42. As shown particularly in FIGS. 1 and 7, convex projection 38 extends vertically above the top surface or web wall 22 of side rails 19. ID addition to stopping the forward rolling movement of a vehicle tire upon it reaching the wheel rest portion of the vehicle ramp, stop 29 due to its unique configuration of dome-shaped projection 38 and channels 39 strengthen and reinforce the ramp again enabling a reduced metal thickness sheet metal material to be utilized in forming the ramp.

Figure 1:
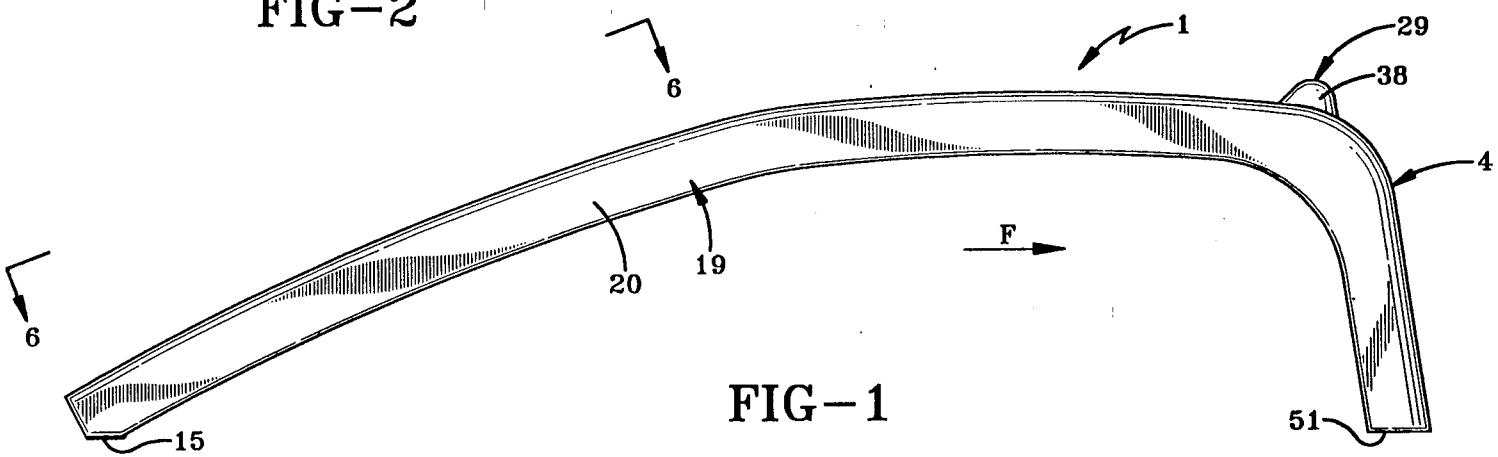
FIG. 1 is a side elevational view of the improved vehicle ramp construction.
Figure 3:
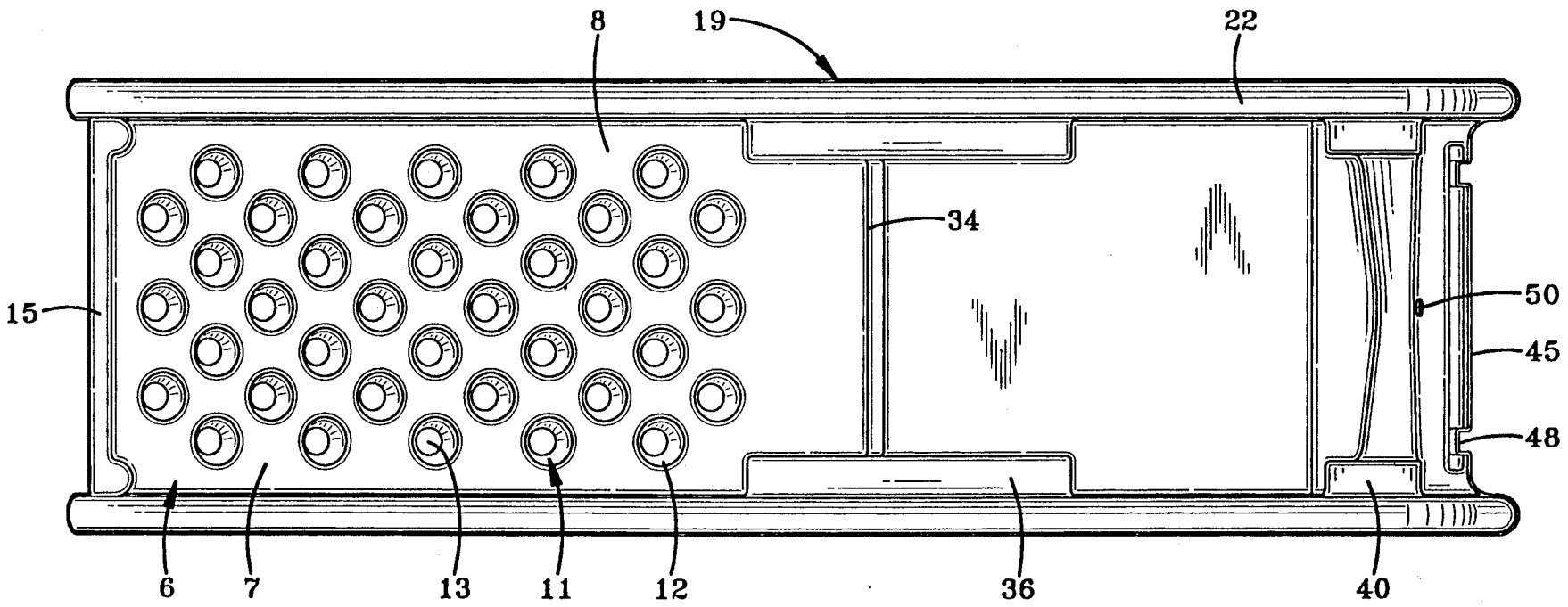
FIG. 3 is a bottom plan view thereof.
Figure 6:
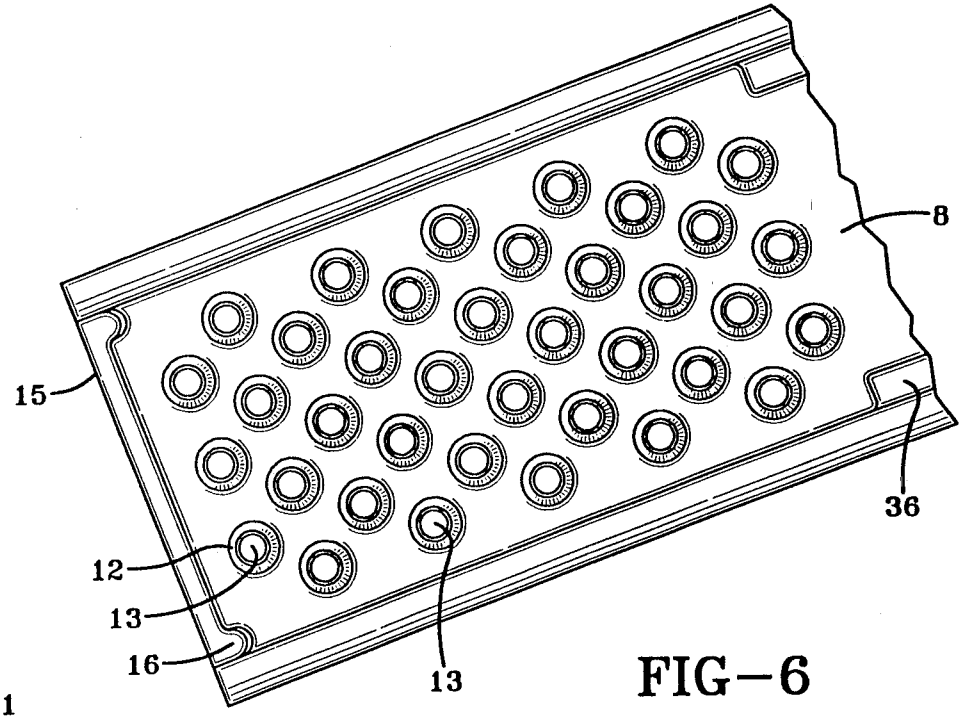
FIG. 6 is a fragmentary plan view looking in the direction of arrows 6—6, FIG. 1.
Figure 4:
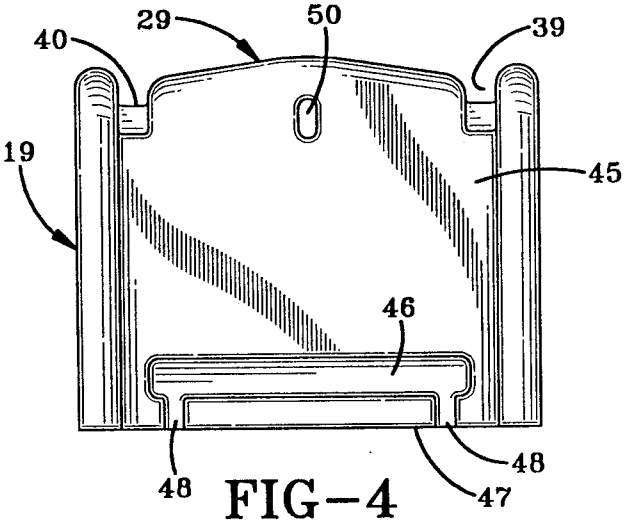
FIG. 4 is a rear elevational view thereof.
Figure 5:
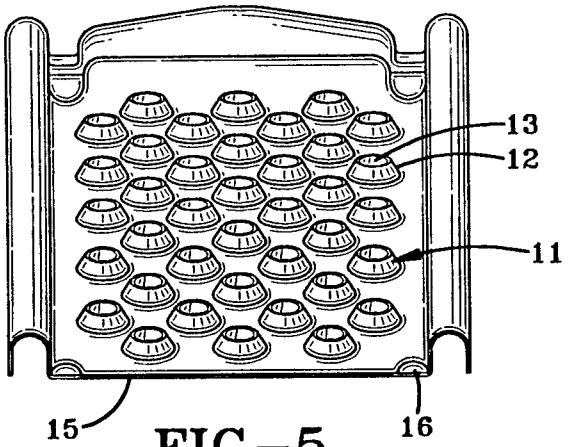
FIG. 5 is a front elevational view thereof.
Figure 7:
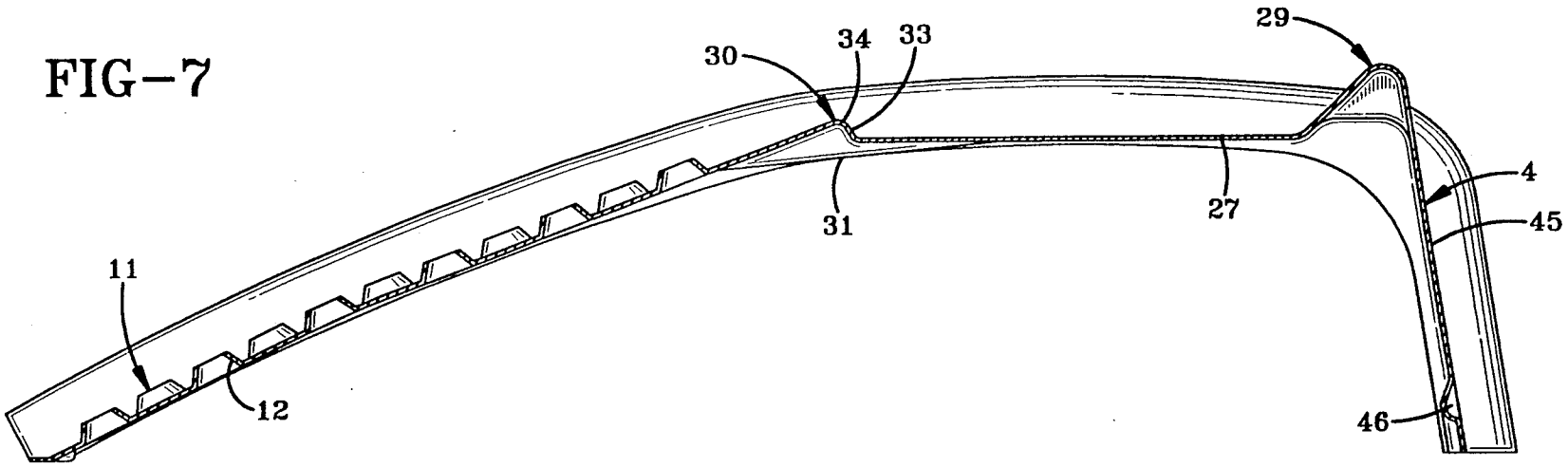
FIG. 7 is a slightly enlarged longitudinal sectional view taken on line 7—7, FIG. 2.
Figure 9:
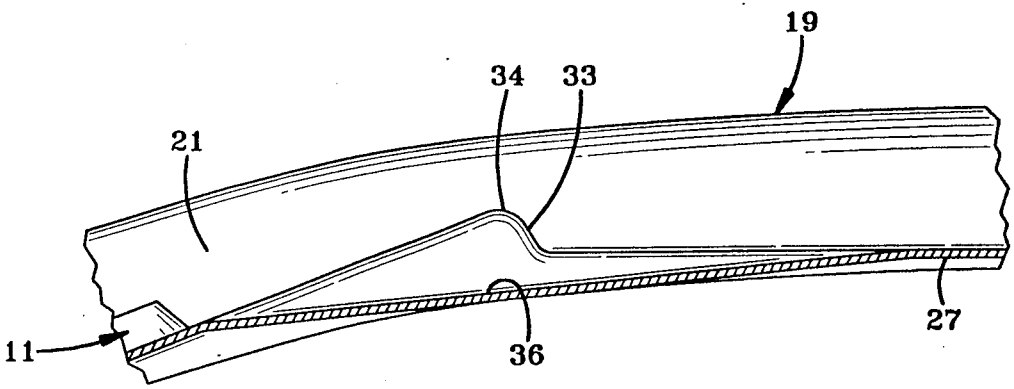
FIG. 9 is an enlarged fragmentary sectional view taken on line 9—9, FIG. 2.

Rear support portion 4 is best shown in FIG. 4, and includes a vertical, generally planar wall 45, which has a transverse depression 46 which extends generally throughout the transverse length of wall 45 adjacent bottom edge 47. Depression 46, in combination with a pair of short vertical depressions 48, provide strength and rigidity to rear wall 45 and thus to vehicle ramp 1. Depressions 48 extend upwardly from bottom edge 47 and communicate with transverse depression 46. An elongated hole 50 may be formed in the upper end of wall 45 to provide a means of storing ramp 1 on a supporting hook or the like. Also as best shown in FIGS. 1, 7 and 12, the bottom edge 51 of rear support portion 4 is adapted to lie on the same horizontal plane as flat bottom area 15 at the front of track 6, to support ramp 1 on a level supporting surface.

In the preferred embodiment, the particular material of ramp 1 is sheet metal having a thickness generally within the range of 0.07 inches and 0.09 inches. This thickness is thinner than that used for most vehicle ramps but due to the various features discussed above and in particular the unique arrangement of the bosses and the configuration thereof, the placement of longitudinal depressions 36 in combination with the raised secondary stop 30, the configuration of rear stop 29 and in particular the dome-shaped configuration thereof in combination with depressions 39 as well as the configuration of rear portion wall 45 and the various stiffening depressions formed therein as well as the formation of transverse flat area 15 and end pads 16 all contribute to the ability to form vehicle ramp 1 of sheet metal thinner than that heretofore used for most vehicle ramps and most importantly without sacrificing any safety to the user thereof by providing a ramp which meets the required standards and load tests. This enables ramp 1 to be stamped in a series of stamping operations to reduce the manufacturing costs thereof as well as a reduction in the material costs due to the thinner thickness material. Also, it is lighter in weight than most prior art ramps thereby making it easier to handle by the user thereof. It has been found that the subject ramp built of gauge thickness discussed above is able to meet the ANSI standard for such ramps not believed heretofore possible with the reduced metal thickness.

Accordingly, the improved ramp construction achieves the stated objectives in a simple, efficient, lightweight unit which is relatively easy to manufacture and is easily used by the mechanic which is free of moving parts which are subject to breakage and which provides the necessary strength and rigidity with a minimum metal thickness.

Accordingly, the improved vehicle ramp is simplified, provides an effective, safe, inexpensive, and efficient device which achieves all the enumerated objectives, provides for eliminating difficulties encountered with prior devices, and solves problems and obtains new results in the art.

In the foregoing description, certain terms have been used for brevity, clearness and understanding; but no unnecessary limitations are to be implied therefrom beyond the requirement of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved vehicle ramp is constructed and used, the characteristics of the construction, and the advantageous, new and useful results obtained; the new and useful structures, devices, elements, arrangements, parts and combinations, are set forth in the appended claims.

I claim:

1. A vehicle ramp including:

a unitary sheet metal body having an inclined ramp portion, a raised wheel rest portion, and a rear support portion;

said ramp portion having a track formed with a plurality of longitudinally spaced parallel transverse rows of outwardly projecting bosses, the individual bosses of each row being located intermediate an adjacent pair of bosses in the longitudinal adjacent row;

said track terminating in a lower transverse planar end adapted to engage the ground and an upper transition zone merging into the wheel rest portion;

stop means adjacent the junction of the wheel rest portion and rear support portion; and a pair of rails extending longitudinally along opposite sides of the ramp portion, the wheel rest portion, and the rear support portion, each having at least first and second arcuate curved portions, said first arcuate portion extending throughout the longitudinal length of the track and into the transition zone, and the second arcuate portion extending from said first arcuate portion throughout the longitudinal length of the wheel rest portion and terminating at the rear support portion.

2. The vehicle ramp defined in claim 1 in which the bosses in each row are equally spaced from each other; and in which every other row has three bosses, with the intervening rows having four bosses.

3. The vehicle ramp defined in claim 2 in which the row of bosses adjacent the lower planar end and transition zone of the track each has three bosses.

4. The vehicle ramp defined in claim 2 in which there are six rows of bosses with three bosses in each row, and five intervening rows of bosses with four bosses in each row.

5. The vehicle ramp defined in claim 1 in which each of the bosses is formed by hollow frustro conical wall terminating in a circular top opening.

6. The vehicle ramp defined in claim 5 in which the vertical height of each of the bosses is approximately ½ the size of the diameter of the top opening of said boss.

7. The vehicle ramp defined in claim 1 in which the lower transverse planar end terminates in a pair of pads adjacent the rails.

8. The vehicle ramp defined in claim 1 in which a pair of longitudinally extending depressions is formed adjacent the rails and extending between the upper end of the ramp portion and partially into the wheel rest portion to resist bending in the wheel rest portion.

9. The vehicle ramp defined in claim 8 in which the wheel rest portion includes a raised inclined front portion which extends transversely between the pair of longitudinal depressions.

10. The vehicle ramp defined in claim 8 in which each of the longitudinal depressions has a generally U-shaped cross-sectional configuration.

11. The vehicle ramp defined in claim 1 in which each of the rails has a generally inverted U-shaped cross-sectional configuration.

12. The vehicle ramp defined in claim 1 in which the rear support portion includes a vertical wall; and in which a transversely extending depression is formed in the rear wall of the support portion adjacent a lower edge thereof.

13. The vehicle ramp defined in claim 12 in which ends of the transverse rear wall depression has opposite ends; and in which said opposite ends are spaced inwardly from the rails.

14. The vehicle ramp defined in claim 13 in which a pair of spaced vertical depressions are formed in the rear wall and extend upwardly from the lower edge thereof and into communication with the transverse depression.

15. The vehicle ramp defined in claim 1 in which the stop means has an upwardly inclined central region and a pair raised generally flat end regions which communicate with said central region.

16. The vehicle ramp defined in claim 15 in which the inclined central region of the stop means projects vertically above the height of the side rails.

17. The vehicle ramp defined in claim 1 in which the track has a first and second inclined planar portions; and in which the first planar portion forms a lesser angle with a horizontal plane than the second planar portion.

18. The vehicle ramp defined in claim 17 in which the first and second planar portions form angles of about 21° and 24°, respectively, with the horizontal plane.

19. The vehicle ramp defined in claim 1 in which the unitary sheet metal body has a thickness in the range of 0.07 inches and 0.09 inches.

20. The vehicle ramp defined in claim 8 in which front ends of the longitudinal depressions terminate adjacent an upper endmost row of bosses.

21. The vehicle ramp defined in claim 8 in which the length of each longitudinal depression is approximately equal to the transverse distance between said depressions.

22. The vehicle ramp defined in claim 1 in which the length of the first arcuate portion of the rails is approximately 19 inches, and the length of the second arcuate portion of the rails is approximately 15 inches.

23. The vehicle ramp defined in claim 22 in which the radii of the first and second arcuate rail portions are approximately 78 inches and 58 inches, respectively.

* * * * *